United States Patent [19]

Badiali

[11] Patent Number: 4,583,356

[45] Date of Patent: Apr. 22, 1986

[54] SPLICER DEVICE TO DISASSEMBLE AND RECOMPOSE YARN MECHANICALLY

[75] Inventor: Roberto Badiali, Pordenone, Italy

[73] Assignee: Officine Savio S.p.A., Pordenone, Italy

[21] Appl. No.: 438,734

[22] Filed: Nov. 3, 1982

[30] Foreign Application Priority Data

Nov. 4, 1981 [IT] Italy ..... 83492 A/81
Nov. 4, 1981 [IT] Italy ..... 83495 A/81

[51] Int. Cl.[4] ..... B65H 69/06; D01H 15/00
[52] U.S. Cl. ..... 57/22; 57/261
[58] Field of Search ..... 57/22, 23, 202, 261-263

[56] References Cited

U.S. PATENT DOCUMENTS

| | | | |
|---|---|---|---|
| 1,950,658 | 7/1931 | Cavanagh et al. | 57/22 |
| 2,028,144 | 4/1931 | Cavanagh | 57/22 |
| 2,362,801 | 11/1944 | Charnock | 57/22 |
| 3,307,339 | 3/1967 | Porter | 57/22 |
| 3,633,352 | 1/1972 | Marriner | 57/22 |
| 4,244,169 | 1/1981 | Ligones et al. | 57/22 |
| 4,341,065 | 7/1982 | Baumgartner et al. | 57/22 |
| 4,386,494 | 6/1983 | Felix | 57/22 |
| 4,407,117 | 10/1983 | Garnsworthy | 57/22 |

FOREIGN PATENT DOCUMENTS

| | | |
|---|---|---|
| 646976 | 5/1964 | Belgium . |
| 0026253 | 4/1981 | European Pat. Off. . |
| 0039609 | 11/1981 | European Pat. Off. . |
| 1919149 | 10/1969 | Fed. Rep. of Germany . |

*Primary Examiner*—John Petrakes
*Attorney, Agent, or Firm*—Stevens, Davis, Miller & Mosher

[57] ABSTRACT

The invention consists of a splicer device to disassemble and recompose yarn mechanically, whereby the splicer device comprises facing disks to untwist and retwist mechanically two yarns positioned between the two disks, a cutter to eliminate excessive tail ends of yarn protruding from the two disks, a crank to set the two disks in rotation, a cam to actuate the cutter that eliminates the excessive tail ends, a lever, cam and spring to provide variable, elastic thrust, momentarily between the two disks, and an actuator which cooperates at least partly with one single programmed actuator.

18 Claims, 9 Drawing Figures

SPLICER DEVICE TO DISASSEMBLE AND RECOMPOSE YARN MECHANICALLY

This invention relates to a piecing-up device to disassemble and recompose yarn mechanically, also known as a splicer.

More particularly this invention relates to a splicer device able to untwist, couple and thereafter retwist two yarns mechanically, in the tract to be spliced.

The splicer device can include advantageously a device suitable for improving the mutual penetration of the fibers of the yarns, substantially during the coupling thereof.

A patent application in the name of CSIRO, was submitted as an application for a European patent on the 5th. May 1981 and entitled, "Method and apparatus for the splicing of two twisted staple yarns". The application is based on provisional application No. PE 3407 filed in Australia.

The present invention forms an improvement and further development of the art shown in the patent application.

The patent application discloses a procedure for splicing textile yarns which comprises disk means, also called "disks" hereinafter, which face each other and rotate in opposite directions to each other and can move axially in relation to each other. The disk means clamp each yarn at points spaced apart diametrically so as to define a specific tract of the yarns themselves, and the yarns are untwisted at the same time in the tract so as to obtain substantially parallel fibers in the yarns. The yarns to a plucking action for separating the fibers in said tract and for forming on each yarn an end portion, or remaining tail, wherein the fibers are not wound or are only slightly wound against each other. The coupled yarns are retwisted in reciprocal contact, whereby the fibers of said tails are retwisted against each other so as to form a splice of the two yarns.

Several inventions exist in the prior art which tend to obtain a knot between the yarns to be spliced by parallel coupling of the fibers.

The various processing philosophies of the known inventions make use of jets of air, electrical currents or electrostatic charges or other systems.

U.S. Pat. No. 3,903,680 acknowledges the principle that, if the yarns undergo an untwisting action and the fibers thus untwisted of the two yarns are intermingled, it is possible, after retwisting the two yarns thus coupled, to obtain a single yarn with a splice actually having the same nature, section and mechanical properties as those of the original yarn.

So as to embody this principle in practice, according to the patent each yarn to be spliced is clamped at two separate points defining a specific tract of yarn.

Each yarn is untwisted in the tract so as to disassemble and separate the fibers and space them apart in order to form two separate tracts of yarn with the fibers disassembled at the end of the yarn.

The disassembled fibers of the end of one of the yarns are separated from each other so as to enable the end of the other yarn, which has not been disassembled, to be inserted into the first end.

The fibers of the second end also are then separated so as to facilitate the interlacing of the fibers belonging to the two yarns.

Lastly, and according to the patent once again, a movement of axial twisting is imparted to at least part of the fibers thus interlaced and the fibers of the two yarns are retwisted together to form the splice.

The preferential embodiments to carry out the procedure now described require that the lengths of the tracts of the two yarns should be substantially the same as the lengths of the fibers forming the two yarns and that, after insertion of the yarns, the yarns themselves should be clamped respectively at points spaced apart at an interval the same as the lengths of the fibers.

Other further embodiments utilize the application of electrostatic forces to separate the fibers of the end of one yarn before the insertion of the end of the other yarn, during combing to disassemble the fibers and to arrange them in a mutually parallel form.

U.S. Pat. No. 2,515,172 acknowledges the need, when splicing the yarns, to untwist the end portions of the yarns, to draw the end portions and then retwist them together.

The patent teaches that the length of the untwisted tract should be greater than the average or maximum length of the fibers and that the twist should preferably be restored to the untwisted tract by the part of the yarn which does not undergo untwisting.

The yarns to be spliced are advantageously overlaid on each other in a substantially diametrically opposite direction and the untwisted portions are drawn and retwisted together at the same time.

The main purpose of the drawing of U.S. Pat. No. 2,515,172 is to arrange the fibers of the two yarns substantially in alignment so as to increase mutual cohesion.

According to the patent the fact that the drawing phase and twisting phase taking place at the same time should increase the cohesion and therefore the strength of the splice.

Lastly, the patent states that the recomposing twist can be effected by allowing the twist stored in the rest of the yarn to be restored to the tract of the splice.

This restoring of the twist imparts to the splice a density of twist the same as or like the original twist of the original yarn provided that the length of the splice after the drawing is about twice the length of the affected end portions of yarn.

This patent neither describes nor claims any air jet device performing said procedure.

The first problem generally found in this kind of procedure is the inability to disassemble the yarns fully before formation of the remaining plucked tails. This is so because the density of twist along normal yarns varies considerably on each side of an average value both as between different yarns and in a single yarn.

This problem entails inadequate formation of the tails, so that the outcome is a weak and/or thick joint.

The second problem concerns the difficulty in controlling and handling the formed tails so as to ensure a proper, full intermingling of the fibers, and also concerns the application of the retwisting needed to constitute a reliable splice.

Notwithstanding the fact that U.S. Pat. No. 3,903,680 proposes to charge the fibers of said tails electrostatically, which could theoretically overcome the second problem, in fact another problem arises in relation to the transfer of the charge to the fibers of the tail which is nominally not charged, difficulties being encountered in handling the tails.

The problems are substantially overcome by the splicer device proposed in our invention by the employment of untwisting means carrying out the untwisting action by friction and by exploiting a natural characteristic of yarns. The characteristic lies in the fact that the diameters of yarns are generally inversely proportional to their density of twist.

The further problem regarding the control of the remaining tails is overcome essentially with the formation of tails in contact with each other and with the clamping of both ends of each tail before the phase of retwisting the coupled yarns.

The device of the application for the European patent cited earlier entails many unsatisfactory aspects, among which the following are the main ones.

A relatively long cycle owing to a distinct separation between the various phases of the cycle.

A constant pressure between the disk means, which does not allow adjustment to suit the requirements of the types of yarn. Moreover, the constant pressure logically has to be set at the maximum or almost maximum value in relation to the untwisting and retwisting phases, and this during the phase of tearing the excessive tail ends does not enable tapered remaining tails to be obtained.

Each device is actuated by its own means, and this entails low reliability, heavier maintenance, greater difficulty in timing and setting, bigger overall sizes, and so on.

The device of the present invention defines untwisting-retwisting means and means to eliminate the excessive tail ends, the whole being able to carry out with precision and uniformity the splicing of yarns by mechanical disassembling and recomposing, at the same time possibly improving the effect with further additional devices such as nozzles, central disturbance means, mixers, turbulence chambers, etc.

The present invention offers many advantages, among which the following are the main ones as compared to the device of the aforesaid application for a European patent.

The phases of the cycle are continuous and overlapping, a fact which shortens the time for performing the cycle and improves the mutual penetration of the fibers belonging to the two yarns.

As the pressure of the disks can be varied as wished, it can be regulated according to specific requirements and can be made to suit every kind of yarn and every important phase, thereby enabling momentarily favorable conditions to be obtained for processing the yarn.

As only one device for coordinated actuation is contemplated, timing and setting can be carried out readily, very little maintenance is needed and the overall size is limited.

As one device of an adjustable type is contemplated for governing the rotation of the disks, it is possible to apply the best working conditions to each kind of yarn.

Possible auxiliary disassembling means are also visualised to ensure full entangling and mutal penetration of the fibers.

In this case a further advantage arises from the fact that it is possible in this way to set a fixed amplitude of rotation of the untwisting-retwisting disks in either direction without regard to the type of yarn to be spliced, since the mutual penetration of the fibers is always ensured by the mutual-penetration and entangling means of the invention even if perfect untwisting of the yarns to be spliced is not obtained.

According to the invention auxiliary disassembling means take part by acting on the fibers of the yarns to be spliced, substantially during the phase of the coupling of the yarns when the fibers are lying substantially parallel between the counter-rotating disks.

The phase takes place substantially during the passage from the untwisting phase to the retwisting phase when the disks, rotating in opposite directions, are substantially momentarily still.

The invention therefore embodies a splicer device to disassemble and recompose yarn mechanically whereby the splicer device comprises opposed disk means to untwist and retwist mechanically the two yarns placed between them, and also comprises means to eliminate the excessive tail ends protruding from the disk means, and means for setting the disk means in rotation and means for actuating the means to eliminate excessive tail ends, the splicer device being characterized by comprising in coordinated cooperation:

means providing a variable elastic resistance which can be momentarily defined between the disk means, adjustable means for setting the disk means in rotation, drive means which cooperate at least partially with one single programmed actuation device, means to position the yarns to be spliced and auxiliary means.

Other details and features of the invention will stand out from the description given below by way of non-limitative example and with reference to the accompanying drawings, in which.

In the figures the same parts or parts having the same functions bear the same reference numbers.

Figure 1:
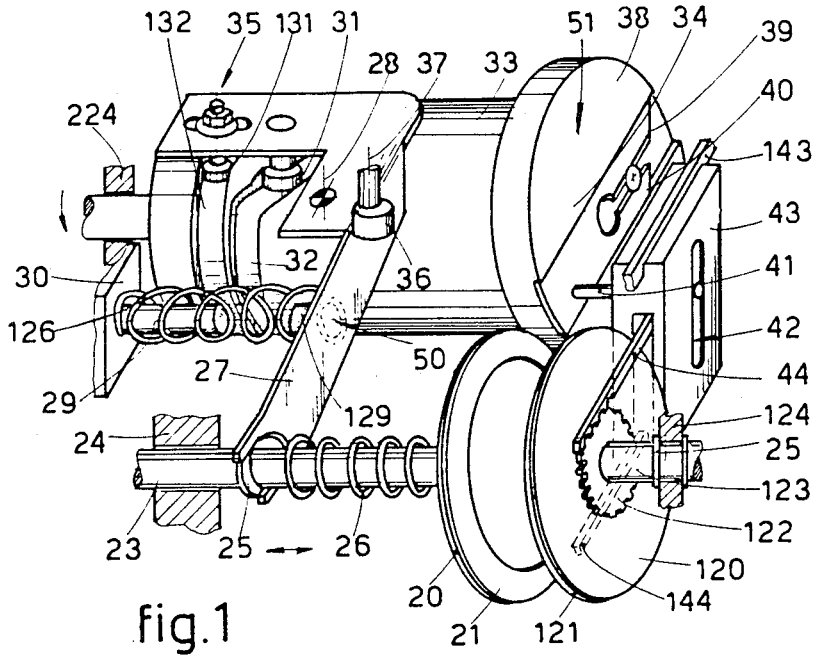
FIG. 1 shows a lay-out of the invention with a mechanical drive.
Figure 2:
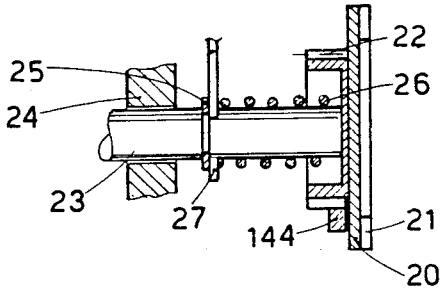
FIG. 2 shows part of the untwisting-retwisting means of the invention.

According to (FIG. 1) the device consists of two facing, opposed disks, each of which is lined on its inner face with a ring of a material having a suitable coefficient of friction 21,121.

A gear wheel 22,122 is secured to each disk 20,120 and serves to actuate the disks 20,120.

Pins 23,123 are solidly fixed to the disks 20,120 and one of them 123 can rotate on its own axis on the support 124 but is prevented from traversing by the stop 25.

Alternatively, the pin 23 can rotate around its own axis on the support 24 and can slide along its own axis on the support 24.

One or both of the pins 23,123 may be bored axially so as to be able to carry fluid, which may be under pressure or contain additives, into the chamber within the rings 21,121 so as perhaps to be able also to actuate mechanisms within the disks.

The fluid can cooperate with means able to improve the intermingling and cooperation of the fibers of the two yarns 46,146.

In FIG. 1 means 50 provide variable elastic thrust and cooperate with the disk 20 and are able to determine the momentary reciprocal positions of the disks 20,120 in the manner required.

Means 50 consist of spring means 26,126, lever means 27 and specific cam means 32,132 positioned in the drum 33.

A small ring 25 is secured on the pin 23 and spring means 26 under tension are located between the disk group 20 and the forked lever 27 acting on the small ring 25.

The lever 27 can rotate on the pivot 28. The spring means 126 guided by the shaft 29 and by a swelling 129 on the lever 27 act on the lever 27.

The spring means 126 react against the stationary wall 30 and thrust the lever 27 in the direction to make the disk 20 close against the disk 120.

The lever 27 bears the small roller 31 fixed in a substantially stationary position, and the latter 31 cooperates with a cam 32 on the drum 33.

The drum 33 is secured to the shaft 34 and can rotate on its own axis but cannot traverse, perhaps being upheld by the support 224 centilever-wise.

The drum 33 is actuated so as to rotate and carries out advantageously, but not necessarily, one revolution for each splice to be made.

The lever 27 bears the small roller 131 secured thereto in a position which can advantageously be adjusted, and the latter 131 is inserted into the cam 132 on the drum 33. The position of the small roller 131 can be adjusted with suitable means 35.

The travel of the lever 27 can be conditioned by eccentric means 36, for instance, which cooperate in the example shown with one edge of the lever 27 itself and can be rotated around the axis 37 and be secured as wished at any position in the 360° of rotation.

Adjustable means 51 at one end of the drum 33 set in rotation the disk means 20,120. In FIG. 1 the adjustable means 51 consist of crank and slotted link means 38 and slider means 43 with racks 44,144.

The drum 33 bears at one end the crank and slotted link means 38 with an adjustable sliding means 39, which can be anchored, for instance, owing to the expansion of the fins 40 caused by suitable screw means.

The sliding means 39 bears a pin 41 which engages with the slot 42 made in the slider 43 guided by means 143.

The slider 43 lodges two racks 44,144 which mesh with the gear wheels 122,22 respectively and serve to impart rotations in opposite directions to the disks 120,20 respectively.

Figure 3:
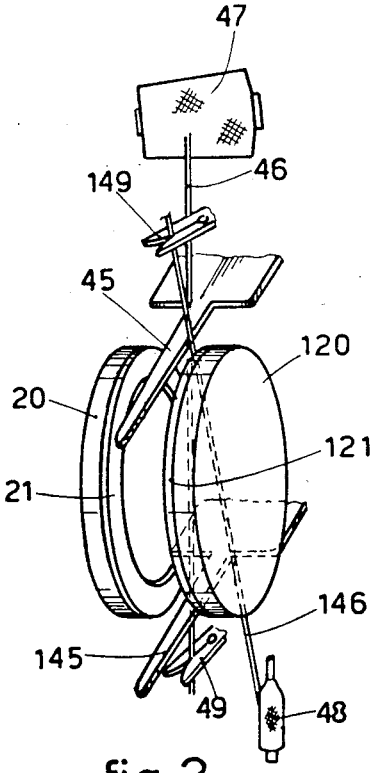
FIG. 3 shows the system for positioning the yarns for the untwisting-retwisting action.

Positioning means 45,145 are comprised advantageously above and below the disk means 20,120 (FIG. 3) and may be movable or stationary. The positioning means 45,145 have the task of positioning the yarns 46,146 in relation to each other and to the disks 20,120, so that the yarns 46,146 become positioned, amongst other things, diametrically as shown. This makes it possible to prevent the yarns from being displaced from their diametrical position during untwisting.

If the positioning means 45,145 are movable, they can move in coordinated cooperation with the slider 43.

The yarns 46,146 cooperate with the positioning means 45,145 respectively.

The yarns 46,146 respectively come from the yarn package 47 and bobbin 48.

Suitable grasping and tearing means 49,149 also cooperate with the yarns 46,146. The grasping and tearing means 49,149 and positioning means 45,145 respectively clamp and position the yarns 46,146 in relation to the disk means 20,120 and in relation to the yarns 146,46 themselves.

The positioning of the yarns 46,146 can also take place in a known way with means outside the subject of the invention and not shown here as they are extraneous to the invention.

The movement of the grasping and tearing means 49,149 to pluck or tear the excessive tail ends can be obtained, for instance, with a cam on the drum 33 or on the periphery of the crank and slotted link means 38.

The grasping and tearing means 49,149 may comprise, for example, a stationary element and a movable element, whereby the movable element can be actuated by thrust means (not shown here) with which the grasping and tearing means 49,149 cooperate in one or more positions during their travel.

Thus, for instance, the means 49,149 stay closed only in the intermediate tract between the fully forward and fully backward positions, the two positions being defined by the thrust means.

The grasping and tearing means 49,149 can also be provided with a movement lengthwise to the yarns 46,146 and away from the disk means 20,120, for instance, so as to facilitate the operation of eliminating the excessive tail ends.

The elimination of the tail ends can be carried out by plucking and tearing or by cutting or else by jointly plucking, tearing and cutting.

If the elimination is carried out by plucking and tearing, it will take place advantageously when the yarn is untwisted, whereas if it is carried out by cutting, it may take place at any useful moment before the yarns 46,146 are coupled.

Figure 4:
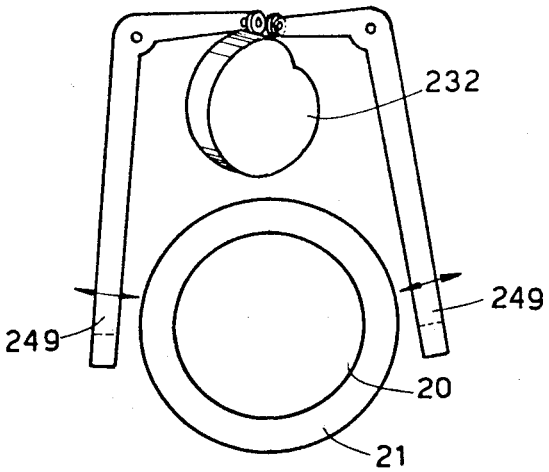
FIG. 4 shows a possible device to eliminate the excessive tail ends.

FIG. 4 shows some grasping and tearing means 249 moving apart sideways owing to actuation by the cam means 232 comprised, for example, on the drum 33 or in cooperation with the drum 33.

The disks 20,120 can be set in rotation also by a transmission of bevelled gear wheels or other equivalent transmission means.

Thus the gear wheels can also set in rotation the cam 32 which serves to actuate the axial approaching and distancing movements of the disks 20,120. The actuation can take place by means of a transmission of gear wheels or belts or with a crank or other means.

The working cycle is diagrammatically as follows. At the beginning the yarns 46,146 are located between the disks 20,120 according to the lay-out of FIG. 3.

When the splicing cycle is started, the disk 20,120 are closed and therefore grip the yarns 46,146 positioned between them, owing to the action of the cam 32 cooperating with the small roller 31 of the lever 27.

Moreover, in that position the disks 20,120 are rotating in a direction such as to untwist the fibers forming the yarns 46,146 themselves.

Adjustment to suit yarns with a Z twist or with an S twist can be carried out, for instance, by pre-setting the racks 44,144 so that the rack 44 is moved to the left and the rack 144 is moved to the right, in such a way that the rack 44 can cooperate with the gear wheel 22, while the rack 144 can cooperate with the gear wheel 122 (see FIG. 1).

The speed and characteristics of the rotation of the disks 20,120 are determined by the position of the sliding means 39 in relation to the crank and slotted link means 38.

The pressure exerted by the forked lever 27 on the disks 20,120 is the maximum for the yarn in question.

When untwisting ends, the pressure exerted by the lever 27 is reduced to the amount desired, owing to the action of the small roller 131, which can be adjusted by the means 35 and cooperates with the cam 132. The direction of rotation is still that of untwisting, while the means 49,149 begin the process of plucking and/or tearing the tail ends of the yarns 46,146 protruding from the disks 20,120.

The disks 20,120 halt and their pressure is slackened off advantageously so as to help the removal of the excessive tail ends.

Thereafter the rotation of the disks 20,120 is inverted and their pressing action become strong again. When the rotation of the disks 20,120 is inverted, the yarns 46,146 are retwisted, one yarn being retwisted together with the other.

The coupling action in the retwisting phase takes place because the yarns 46,146 are no longer held by the grasping and tearing means 49,149.

The coupling and retwisting action obtains a homogeneous tract of yarns not unlike the rest of the yarn since the plucking and tearing action, which we deem advantageous, has provided remaining tails which are progressively tapered.

When retwisting ends, the disks 20,120 halt and are moved asunder, thus freeing the finished splice.

According to the invention the crossed position of the yarns 46,146 is preferential since they are placed along diameters of the disks and therefore the untwisting action does not create a displacement in the yarns themselves inasmuch as the yarns pass through the center of rotation of the disks 20,120.

Furthermore, the presence of the means 45,145 and 49,149 ensures the perfect symmetry of the crossover of the yarns 46,146 and their proper positioning along diameters of the disks 20,120.

Moreover, the presence of the crank and slotted link means 38 or other like means which permit adjustment enables the rotation of the disks 20,120 to be proportioned to the requirements dictated by the type of yarn to be spliced.

In fact, the crank and slotted link means 38 make it possible to have a rotation which can be varied from nil, when the pin 41 is on the axis 34 of the drum 33, to the maximum value permitted by the crank and slotted links means 38 themselves.

This range of adjustments enables the splicer device to be regulated to suit the different kinds of yarn.

Figure 5:
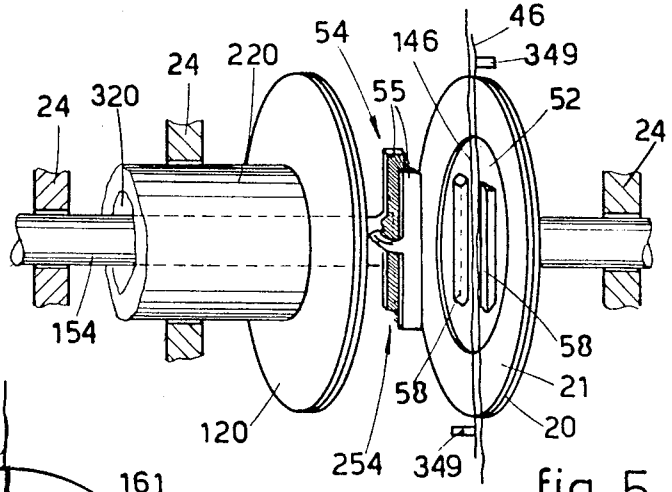
FIG. 5 shows another embodiment of the splicer device of the invention.

According to the embodiment of FIG. 5 the splicer device consists essentially of two coaxial opposed disks 20,120 able to be set in rotation in opposite directions to each other by suitable means which are not shown here but which take steps to rotate the disks 20,120 with a pre-set amplitude of rotation depending on the count and type of yarns 46,146 to be spliced, whereby the free ends of the yarns 46,146 are positioned and clamped with grasping and tearing means 349, shown diagramatically, each of which is located on a side of the disks 20,120.

The disks are held by supports 24 with suitable bearings which are not shown here.

At least one of the disks, 120 in this case, can be moved axially towards the other 20 by suitable means that are not shown here and each disk 20,120 is equipped with an inner annular concentric chamber 52,152.

This enables the yarns 46,146 being spliced to be clamped at two diametrically opposite points between the circumferential edges 53,153 formed around the inner chambers 52,152 of the disks 20,120.

So as to make the splice, the disks 20,120 are first pressed against each other, thus clamping the yarns 46,146 between them. Next, the disks are rotated at the same time in opposite directions so as to untwist the fibers in the tract comprised between them and to couple the two yarns. The disks are then rotated in a direction opposite to that of their previous rotation so as to retwist the fibers of the yarns together after the excessive tail ends have been removed by the grasping and tearing means 349 at the end of the foregoing untwisting.

Means 54 cause mutual penetration of fibers and take part in the splicing operation substantially and advantageously during the passage from the untwisting phase to the phase of retwisting the fibers and may also carry on their work during the retwisting phase or part thereof.

Means 54 have the purpose of improving the mutual penetration of the fibers of one yarn 46 into the fibers of the other yarn 146 and of permitting reciprocal cooperation of said fibers so as to create a solid splice without having to provide the disks 20,120 with a greater amplitude of retwisting rotation than the amplitude of the opposite rotation effected during the untwisting phase.

Device 54 causing mutual penetration has, in its simplest form, a shank 154 positioned coaxially within one of the disks 20,120, in this case within the movable disk 120, in the carrying shaft 220 of which a central hole 320 is bored.

Shank 154 can be moved axially with suitable displacement means of a known type and therefore not shown here.

At its inner end the shank 154 comprises means 254 for entangling fibers which can act on the fibers of the two yarns so as to improve the mutual penetration or said fibers at the time when the fibers of said yarns are substantially parallel and in reciprocal contact.

Figure 6:
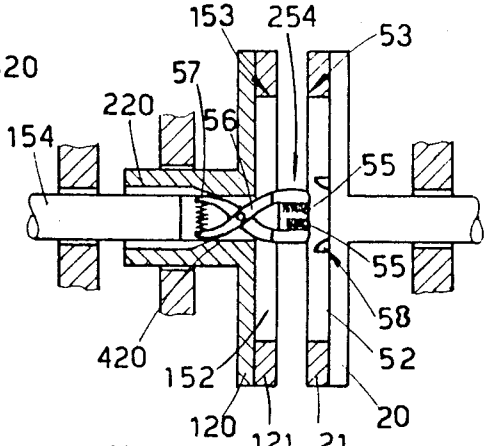
FIG. 6 shows a horizontal section of the device shown in FIG. 5.

In the embodiment of FIGS. 5 and 6 the entangling means 254 consist of a pair of brushes formed with needles 55 fitted to two scissor-wise arms 56 pivoted on the inner end of the shank 154 and kept open by a spring 57 located between the opposed ends of the arms 56.

Closure of the needle-wise brushes 55 against the untwisted fibers is carried out by the profiled cams 58, which in this instance are located on the stationary disk 20 and act on the needle-wise brushes 55 and make them close when the brushes are in the forward working position in the two sides of the yarns 46,146, but the closure could also be obtained with a narrowed portion 420 formed in the diameter of the hole 320 of FIG. 6, whereby the narrowed portion tends to bring the inner ends of the scissor-wise arms 56 together.

Figure 7:
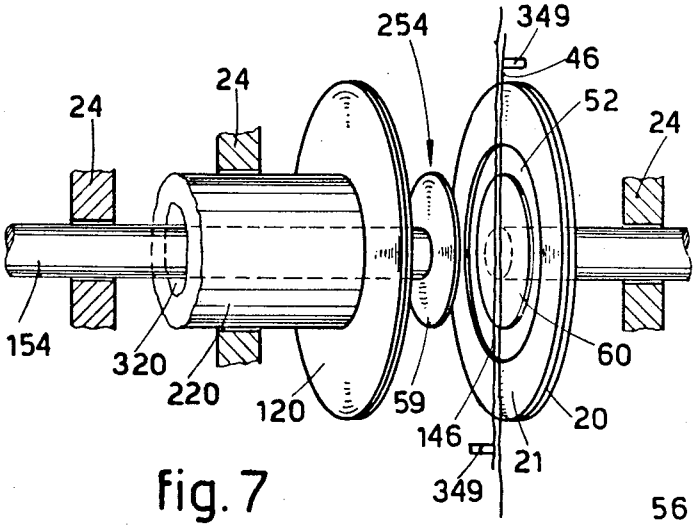
FIG. 7 shows a still further embodiment of the splicer device of the invention.
Figure 8:
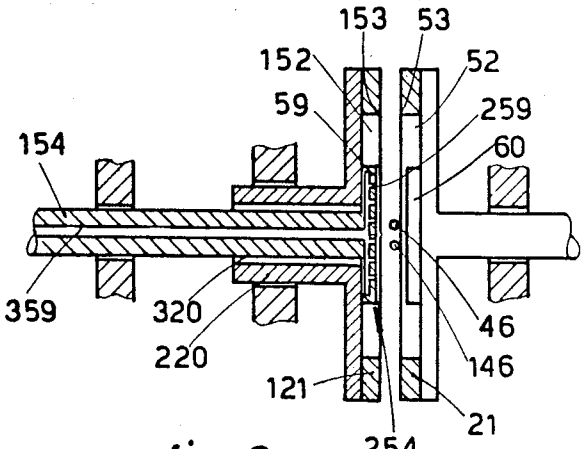
FIG. 8 shows a horizontal section of the device of FIG. 7.

FIGS. 7 and 8 show another embodiment of the invention wherein the means 54 that entangle the fibers consist of an oscillating disk 59 fitted to the inner end of the shank 154, whereby the disk is equipped with nozzle means, or nozzles, 159, such as a plurality of substantially axial small holes 259 which communicate with an axial conduit 359 machined in the shank 154.

The axial conduit 359 is connected at one end by a hose or other means to a source of fixation liquid such as air, steam, water, oil or another, which is sprayed on the untwisted fibers of the yarns 46,146.

The disk 59 is equipped with other actuation means which are not shown here but which act preferably by means of the shank 154 and are able to oscillate the disk 59 quickly while it is pressed against the yarns 46,146 and rests advantageously against a supporting disk 60 fitted coaxially within the annular chamber 52 of the stationary disk 20.

The flow of liquid may be delivered through the small holes 259 at the same time as the disk 59 is being oscillated quickly, so as to improve mutual penetration of said fibers and to fix the twists which will be imparted to said fibers thereafter.

The disk 59 can also be lined with a material (not shown here) able to produce considerable friction against the yarn, and like coatings or linings of a material producing friction could also be present on the facing supporting disk 60.

Thus both the nozzle means 159 and the aforesaid material may produce friction in cooperation on the disk 59.

Figure 9:
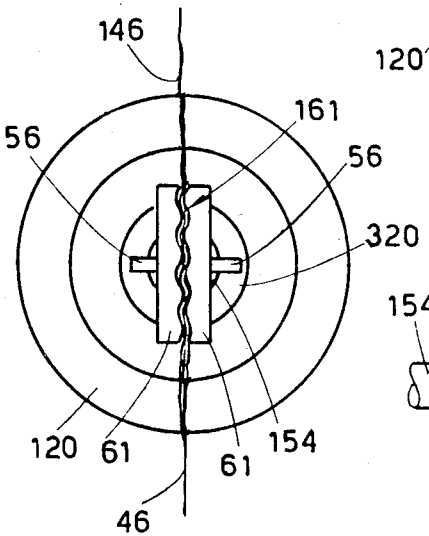
FIG. 9 shows an alternative form of the means for entangling the fibers.

A further variant of the embodiment already described and shown in FIGS. 5 and 6 consists in replacing the two needlewise brushes 55 with two pads 61 seen from the front in their working position in FIG. 9.

The pads 61 have on their inward sides complementary corrugated surfaces 161 between which the untwisted yarns 46,146 stretch without being pressed. According to this variant the pads 61 are kept in this position during the whole retwisting phase as well.

Indeed, it has been found that when the fibers of the yarns 46,146 being retwisted are forced to keep a wound development lengthwise and also to turn around each other, they improve the mutual penetration and provide a stronger splice.

Some embodiments of the invention have been described merely as non-restrictive examples, but other embodiments and modifications are possible for a person skilled in this field without departing thereby from the scope of the invention.

It is possible to vary shapes, dimensions and sizes and to utilize different actuation and handling means. It is also possible to combine the embodiments described and apply possible improvements, the whole being within the scope of this invention.

INDEX

20-disk
120-disk
220-carrying shaft
320-central hole
420-narrowed portion
21-ring of material producing friction
121-ring of material producing friction
22-gear wheel
122-gear wheel
23-pin
123-pin
24-support
124-support
224-support
25-small rings
26-spring means
126-spring means
27-lever
28-pivot
29-shaft
129-swelling
30-stationary wall
31-small roller
131-small roller
32-cam
132-cam
232-cam means
33-drum
34-shaft/axis
35-adjusting means
36-end-of-travel means
37-axis of end-of-travel means
38-crank and slotted link means
39-sliding means
40-fins
41-fins
42-slot
43-slider
143-guide means
44-rack
144-rack
45-positioning means
145-positioning means
46-yarn
146-yarn
47-yarn package
48-bobbin
49-grasping and tearing means
149-grasping and tearing means
249-grasping and tearing means
349-grasping and tearing means
50-means providing elastic thrust
51-adjustable means
52-annular chamber
152-annular chamber
53-circumferential edge
153-circumferential edge
54-means to cause mutual penetration of fibres
154-shank
254-entangling means
55-brushes formed with needles
56-arms
57-spring
58-cams
59-oscillating disk
159-nozzle means
259-holes
359-axial conduit
60-supporting disk
61-pads
161-corrugated surfaces

I claim:

1. Splicer device to disassemble and recompose yarn mechanically comprising facing disk means to untwist and retwist mechanically two yarns positioned between said disk means, means to eliminate excessive tail ends of yarn protruding from said disk means, adjustable means to set said disk means in rotation, means to actuate said means that eliminate the excessive tail ends, means providing a variable, elastic thrust which can be defined momentarily between said disk means, and actuation means which cooperate at least partly with one single programmed actuation means.

2. The splicer device to disassemble and recompose yarn mechanically as in claim 1, wherein said single programmed actuation means is a cam and wherein the momentarily definable, variable, elastic thrust means consist of elastic means and lever means cooperating with at least one disk means, said lever means cooperating with said at least one cam means.

3. The splicer device to disassemble and recompose yarn mechanically as in claim 2, including means to regulate travel of said lever, said means to regulate travel cooperating with the lever means.

4. The splicer device to disassemble and recompose yarn mechanically as in claim 1, wherein the adjustable means to set the disk means in rotation comprise at least means to regulate the degree of rotation.

5. The splicer device to disassemble and recompose yarn mechanically as in claim 1, wherein the adjustable means to set the disk means in rotation comprise at least means to adjust the speed of rotation.

6. The splicer device to disassemble and recompose yarn mechanically as in claim 5, wherein the speed of rotation adjusting means are means which perform mechanical actuation crank-wise.

7. The splicer device to disassemble and recompose yarn mechanically as in claim 1, wherein the actuation means is a drum.

8. The splicer device to disassemble and recompose yarn mechanically as in claim 1, including means to position yarns to be spliced, said yarns crossing over each near the axis of rotation of the disk means.

9. The splicer device to disassemble and recompose yarn mechanically as in claim 1, wherein the disk means have front faces comprising at least one ring made of a material having a high coefficient of friction in relation to said yarn.

10. The splicer device to disassemble and recompose yarn mechanically as in claim 1, including fiber-entangling means inserted between said counter-rotating disks so as to act on said fibers to cause mutual penetration of the fibers of the untwisted yarns, said entangling means being equipped with suitable displacement means within the space between said counter-rotating disks.

11. Splicer device to disassemble and recompose yarn mechanically comprising facing disk means to untwist and retwist mechanically two yarns positioned between said disk means, means to eliminate excessive tail ends of yarn protruding from said disk means, adjustable means to set said disk means in rotation, means to actuate said means that eliminate the excessive tail ends, means providing a variable, elastic thrust which can be defined momentarily between said disk means, actuation means which cooperate at least partly with one single programmed actuation means and fiber-entangling means inserted between said counter-rotating disks so as to act on said fibers to cause mutual penetration of the fibers of the untwisted yarns, said entangling means being equipped with suitable replacement means within the space between said counter-rotating disks, one of said counter-rotating disks defines a hole made coaxially therein and each counter-rotating disk defines an annular chamber therein, said means causing mutual penetration being located in said hole and annular chamber.

12. The splicer device as in claim 11, including axial displacement means and wherein said means causing mutual penetration comprise a slidable shank arranged partially within said hole and bears means to entangle fibers on its inner end protruding within the annular chamber of a counter-rotating disk, the other end of said shank being connected to said axial displacement means.

13. The splicer device as in claim 12, wherein said means to entangle fibers consist of a pair of brushes formed with needles and fitted to the ends of two scrissor-wise arms pivoted at said inner end of said shank and kept apart from each other by a spring located between the opposite ends of said arms.

14. The splicer device as in claim 13, including means to actuate the needle-wise brushes consisting of at least one profiled cam located on the counter-rotating disk opposite to the counter-rotating disk defining the annular chamber which lodges said needle-wise brushes, said cam cooperating with the relative needle-wise brush.

15. The splicer device as in claim 13, wherein said means to actuate the needle-wise brushes consist of a narrowed portion on the inner diameter of the end part of the hole, said narrowed portion acting on the inner ends of the scissor-wise arms which bear the needle-wise brushes at their other ends.

16. The splicer device as in claim 13, including a narrow portion on the inner diameter of the end part of the hole and wherein said entangling means consist of a pair of pads which have complementary, corrugated, inner faces and are fitted to the ends of two scissor-wise arms pivoted at said inner end of said shank and kept asunder by a spring located between the opposite ends of said arms, said narrowed portion acting on the inner ends of the scissor-wise arms bearing said pads so as to keep the surfaces of the two pads in substantially distanced working positions.

17. The splicer device as in claim 12, wherein said means to entangle fibers consist of a disk fitted to the inner end of the axially movable shank, said shank having an axial conduit therein, said disk being equipped with nozzles communicating with said conduit within said axially movable shank, said conduit being connectable to a source of a suitable liquid and said shank being connectable to actuation means which oscillate the disk quickly.

18. The splicer device as in claim 12, wherein the means to entangle fibers consist of two disks, one an oscillating disk located on the inner end of said axially movable shank, said disk having on its inner face a layer of a material able to produce considerable friction against the yarn, and the other an opposed counter-rotating disk, said other disk having a layer of material able to produce considerable friction against the yarn, said one disk being actuatable with quick oscillations from the outer end of said shank.

* * * * *